United States Patent [19]

Metz

[11] 4,387,761

[45] Jun. 14, 1983

[54] NOZZLE FOR ROTARY CONTINUOUS CASTER

[75] Inventor: Paul Metz, Brasseur, Luxembourg

[73] Assignee: Arbed S.A., Luxembourg, Luxembourg

[21] Appl. No.: 216,539

[22] Filed: Dec. 15, 1980

[30] Foreign Application Priority Data

Dec. 17, 1979 [LU] Luxembourg ..... 82001

[51] Int. Cl.[3] ..... B22D 11/10

[52] U.S. Cl. ..... 164/437; 164/438; 164/489

[58] Field of Search ..... 164/437, 438, 439, 504, 164/468, 488, 489, 499, 147.1

[56] References Cited

FOREIGN PATENT DOCUMENTS 887556 12/1971 Canada ..... 164/437
1802884 6/1970 Fed. Rep. of Germany .
2156373 5/1973 France .
66317 10/1972 Luxembourg .
748709 5/1956 United Kingdom .

*Primary Examiner*—Nicholas P. Godici
*Assistant Examiner*—Jerold Johnson
*Attorney, Agent, or Firm*—Karl F. Ross; Herbert Dubno

[57] ABSTRACT

Molten metal is introduced in a continuous-casting system downwardly into a mold through a nozzle opening downwardly into the mold at an axis to form in the mold a body of molten metal having an upper surface carrying impurities above the mouth of the mold. The body of molten metal is rotated about the axis in the mold. The nozzle is provided generally at the level of the upper surface of the body of molten metal with radially outwardly projecting vanes that prevent the body from rotating about the axis at the upper surface, thereby preventing inclusions from being sucked into the body of molten metal.

9 Claims, 4 Drawing Figures

NOZZLE FOR ROTARY CONTINUOUS CASTER

FIELD OF THE INVENTION

The present invention relates to a nozzle for a rotary continuous caster. More particularly this invention concerns such a nozzle used for introducing liquid molten metal underneath the slag on top of a downflow-type continuous-casting mold.

BACKGROUND OF THE INVENTION

In downflow continuous casting it is standard practice to swirl or rotate the body of liquid metal about a vertical axis on which the mold is centered. Such rotation produces a very fine structure in the metal which is considered highly desirable, producing an extremely strong casting with a good surface.

Such rotation can be carried out either mechanically by means of a sample stirring instrument or pneumatically by means of a gas stream. More commonly, however, electromagnetic coils are arranged around the mold to inductively rotate it.

The main problem with this method is that the impurities which normally collect on the top of the molten metal, or even the slag intentionally left there, is partially sucked into the vortex formed at the center of the downwardly moving and swirling molten body. Thus the center of the casting thus produced will have a great deal of impure inclusions that considerably detract from the overall quality of the workpiece.

It has been suggested to eliminate this problem by injecting the melt into the mold below the surface thereof by means of a nozzle shaped like a funnel and having a lower outlet end that is positioned underneath the surface of the body of the melt, below the melt/slag interface. Such procedures do somewhat reduce the above-described problem, nonetheless the vortex which starts right at the top of the melt remains so that some of the material floating on top of the melt is, indeed, sucked down into the molten mass.

OBJECTS OF THE INVENTION

It is therefore an object to provide an improved rotary-type continuous casting system.

Another object is to provide such a casting system wherein sucking of impurities down into the body being cast is eliminated.

SUMMARY OF THE INVENTION

These objects are attained according to the instant invention in a continuous-casting system of the above-described type wherein the molten metal is introduced downwardly into a mold through a nozzle opening downwardly into the mold at an axis to form in the mold a body of the molten metal having an upper surface carrying impurities above the mouth of the mold, and wherein the body of molten metal is rotated about the axis in the mold.

According to this invention the nozzle is provided generally at the level of the upper surface of the body with radially outwardly projecting vanes that prevent the body from rotating about the axis at the upper surface. Thus in an extremely simple manner the formation of a vortex which opens at the upper surface of the body of molten metal and which can suck in impurities is completely avoided. The upper surface of the body of molten metal is mechanically prevented from rotating, whereas below this upper surface rotation is possible in the normal manner.

The mold is rectangular, normally square, in horizontal cross section. According to this invention four vanes are provided which may be directed perpendicularly at the sides of the mold or diagonally at the corners thereof. In either case the overall horizontal dimension formed by two in-line vanes plus the intervening tube is equal to between 50% and 95% of the corresponding dimension measured between the inner walls of the mold. Longer vanes are used when they are perpendicular to the side walls, and shorter ones when they are diagonal toward the corners, as there is little tendency for the body to rotate at the corners in any case. The length is limited in accordance with the flowability of the metal so as to prevent it from solidifying at the surface of the body.

The vanes according to this invention may be of rectangular shape, or may have horizontal upper edges and downwardly and outwardly concavely curved lower edges. It is also possible to form the vanes at least partially twisted helically about the axis, with a direction or hand of twist which is opposite to the direction or hand of rotation of the body in the mold.

It is also possible to provide a motor or the like that rotates the vane assembly in a direction opposite the direction of the melt so as further to inhibit formation of a vortex.

The nozzle and vanes may be unitary, or the vanes may be mounted on a collar that surrounds a central tube constituting a standard injection nozzle. With this last-mentioned system it is therefore possible to adapt the instant invention to existing continuous-casting systems.

SPECIFIC DESCRIPTION

Figure 1:
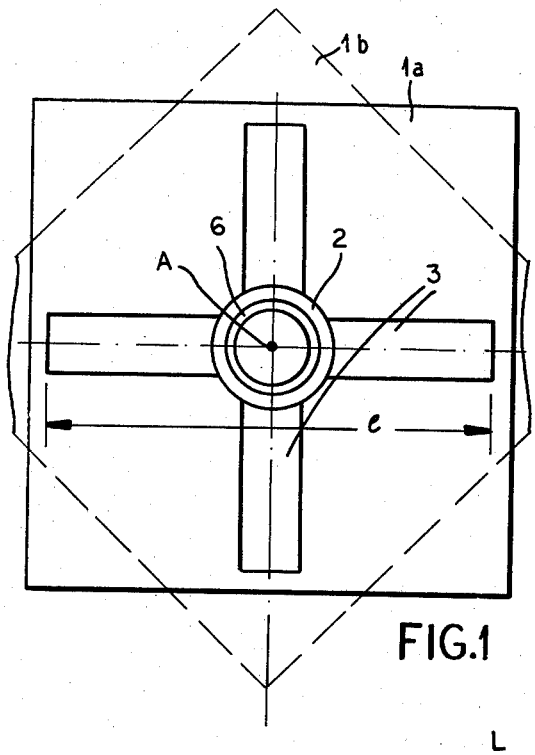
FIG. 1 is a top view of a continuous-casting system according to this invention.
Figure 2:
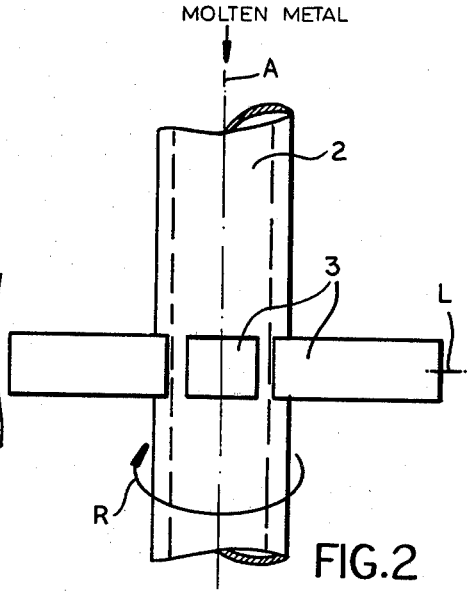
FIG. 2 is a side view of the nozzle of FIG. 1.

FIGS. 1 and 2 show how a tubular nozzle 2 can descend along an axis A inside a square-section mold 1*a* or 1*b*. This tubular nozzle 2 carries four rectangular vanes 3 offset at 90° to each other and arranged either perpendicular to the side walls of the mold 1*a* or diagonal to the corners of the mold 1*b*. Two in-line vanes 3 have with the tube 2 an overall length 1 perpendicular to the axis A which is equal to between 50 and 95% of the corresponding dimension of the mold 1*a* or 1*b*.

During operation molten metal, normally steel, is poured from a tundish into the top of the tube or nozzle 2 or into a tube or collar 6 provided outside the tube 2, and issues from the lower end thereof below a level L which corresponds to the interface between a layer of slag or other impurities floating on top of the body of molten metal formed in the mold 1*a* or 1*b* and this body. Coils or the like are provided underneath the vanes 3 to rotate the body of molten metal in the direction R about the axis A.

Obviously the vanes 3 will mechanically prevent the uppermost portion of the molten body of metal from rotating about the axis A, so that no vortex will be formed which could suck in slag from the layer of slag floating on the top.

Figure 4:
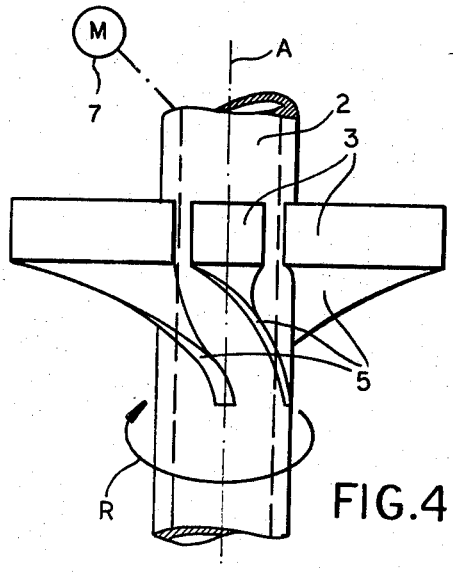

It is also possible as shown in FIG. 4 to provide underneath each of the vanes 3 a vane extension 5 extending generally helically in a direction or hand opposite the rotation direction R. FIG. 4 also shows how a motor 7 can be connected to the tube 2 and therethrough to the vanes 3 and extensions 5 to rotate them in a direction opposite the direction R so as further to inhibit formation of a vortex at the top of the body.

Figure 3:
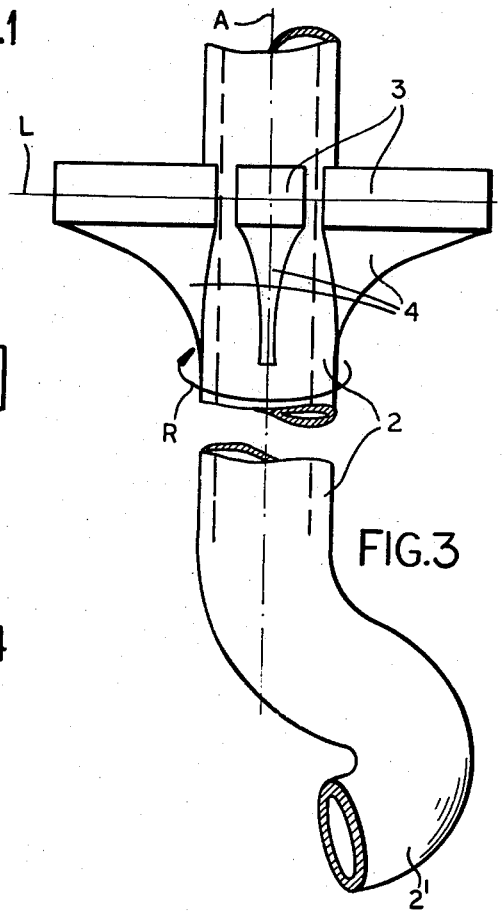
FIGS. 3 and 4 are side views of further nozzles according to this invention.

In FIG. 3 yet another arrangement is shown wherein the vanes 3 have downwardly extending projections 4 which lie axially in line with the vanes 3 and which have outwardly and downwardly concave edges. The tube 2 has a lower end 2' which opens tangentially of the axis, that is transversely thereto but spaced radially outward therefrom so as to impart rotation to the body of molten metal poured in through the tube 2.

I claim:

1. In a continuous-casting system wherein molten metal is introduced downward into a mold through a nozzle opening downward into said mold at an axis to form in said mold a body of said molten metal having an upper surface carrying impurities above the mouth of said nozzle, and wherein said body of molten metal is rotated about said axis in said mold, the improvement wherein said nozzle is provided generally at the level of said upper surface of said body with radially outwardly projecting vanes that prevent said body from rotating about said axis at said upper surface, the vanes each having a horizontal upper edge and a concave lower edge.

2. The improvement defined in claim 1 wherein said mold is of rectangular horizontal cross section and said vanes number four and are each generally perpendicular to a respective side of said mold.

3. The improvement defined in claim 1 wherein said mold is of rectangular horizontal cross section and said vanes extend diagonally in said mold.

4. The improvement defined in claim 1 wherein said mold has a horizontal inside dimension parallel to each of said vanes and said vanes each have together with said nozzle a horizontal length equal to between 50% and 95% of the respective horizontal dimension.

5. The improvement defined in claim 1 wherein said vanes are parallelopipeds.

6. The improvement defined in claim 1 wherein said vanes are unitary with one another.

7. The improvement defined in claim 1 wherein said vanes are formed on a collar fitting over a tube constituting said nozzle, wherein said collar with said vanes can be fitted over a conventional nozzle.

8. In a continuous-casting system wherein molten metal is introduced downward into a mold through a nozzle opening downward into said mold at an axis to form in said mold a body of said molten metal having an upper surface carrying impurities above the mouth of said nozzle, and wherein means is provided for rotating said body of molten metal about said axis in said mold, the improvement wherein said nozzle is provided generally at the level of said upper surface of said body with radially outwardly projecting vanes that prevent said body from rotating about said axis at said upper surface, each of said vanes being twisted generally helically about said axis in a hand opposite the hand of rotation of said melt in said mold.

9. In a continuous-casting system wherein molten metal is introduced downward into a mold through a nozzle opening downward into said mold at an axis to form in said mold a body of said molten metal having an upper surface carrying impurities above the mouth of said nozzle, and wherein means is provided for rotating said body of molten metal about said axis in said mold, the improvement wherein said nozzle is provided generally at the level of said upper surface of said body with radially outwardly projecting vanes that prevent said body from rotating about said axis at said upper surface and said system is provided with means for rotating said vanes in said mold about said axis in a direction opposite the direction of rotation of said melt in said mold.

* * * * *